United States Patent [19]

Siedband

[11] 4,361,900

[45] Nov. 30, 1982

[54] RADIATION MONITORING DEVICE

[75] Inventor: Melvin P. Siedband, Madison, Wis.

[73] Assignee: Victoreen, Inc., Cleveland, Ohio

[21] Appl. No.: 208,549

[22] Filed: Nov. 20, 1980

[51] Int. Cl.[3] ..... H05G 1/26

[52] U.S. Cl. ..... 378/98; 378/111

[58] Field of Search ..... 250/252, 394, 401, 402; 378/98, 111

[56] References Cited

U.S. PATENT DOCUMENTS

| | | | |
|---|---|---|---|
| 2,539,203 | 1/1951 | Pohl | 250/402 |
| 3,515,873 | 6/1970 | Higgins et al. | 250/252 |
| 3,766,383 | 10/1973 | Harris et al. | 250/252 |
| 4,097,736 | 6/1978 | Jacobson et al. | 250/252 |
| 4,189,645 | 2/1980 | Chaney et al. | 250/252 |

*Primary Examiner*—Alfred E. Smith
*Assistant Examiner*—T. N. Grigsby
*Attorney, Agent, or Firm*—Wilson, Fraser, Barker & Clemens

[57] ABSTRACT

The present invention relates to a radiation monitoring device which is utilized to measure the voltage supplied to an x-ray generator of an x-ray machine in terms of kVp units. The device includes a pair of detectors which are simultaneously exposed to an x-ray beam. The x-ray beam is filtered by a first amount before being supplied to the first detector, and is filtered by a second amount, greater than the first amount, before being supplied to the second detector. Both detectors generate an output signal having a magnitude proportional to the amount of radiation energy received. The ratio between the detector output signals is proportional to the amount of voltage supplied to the x-ray generator. The output signal of the first detector is an input to a first integrator which generates a voltage ramp output signal as an input to a trigger circuit. The output of the second detector is supplied to a second integrator which generates a second voltage ramp output signal as an input to a sample/hold circuit. When the magnitude of the ramp output signal of the first integrator reaches a predetermined reference level, the trigger circuit generates a signal to the sample/hold circuit which then stores the value of the output of the second integrator. The ratio between the stored value and the predetermined reference level corresponds to the ratio between the outputs the first and second detectors. The stored value is then biased to yield a voltage proportional by a multiple of ten to the actual kVp of the beam, such that a conventional voltmeter can be used to directly indicate the voltage in kVp units.

12 Claims, 3 Drawing Figures

RADIATION MONITORING DEVICE

BACKGROUND OF THE INVENTION

In high quality medical radiology, it has always been desirous to measure the kVp (high voltage peak waveform) supplied to an x-ray generator in order to properly maintain an x-ray machine in precise calibration. Inaccurate calibration of an x-ray generator can result in poor radiographs, shortened component life, and possible violation of the Radiation Control Act. Because the voltages which are fed by a pair of cables to the x-ray generator in the diagnostic mode range from thirty to seventy-five kVp per cable for a total of sixty to a hundred fifty kVp, it is undesirable to make a direct measurement of such high voltage. This is especially the case for persons unskilled in the art of handling such high voltage apparatus.

One prior art device which has attempted to provide a means for calibrating an x-ray machine includes a high voltage divider having two large resistance sections which are connected between the anode of the x-ray generator and ground and between the cathode of the generator and ground. Although the high voltage divider provides a satisfactory measuring circuit, such a device can only be utilized by qualified personnel.

Another attempt to provide a means for calibrating radiographic equipment consists of a step wedge penetrometer. The penetrometer is constructed of a metal such as copper or aluminum and includes a series of steps each having an increased thickness to provide greater attenuation of the x-ray beam. In operation, the step wedge penetrometer is placed on a detector such as standard x-ray film and exposed to the x-ray beam. The film is then compared to another exposure made without the use of the penetrometer but using a detector of lower sensitivity. The lower sensitivity detector can either be another x-ray film of reduced sensitivity, or the same type of film used with the penetrometer, but fed through an attenuator. The density of the step wedge image is related to the effective kVp of the x-ray beam. While such a measurement technique is effective and successful, making a succession of exposures to completely calibrate a system is a laborious and time consuming task.

SUMMARY OF THE INVENTION

The present invention relates to a radiation monitoring device which can be utilized to precisely calibrate an x-ray machine without any direct electrical connection to the machine. The device includes a pair of radiation detectors, such as photomultiplier tubes with associated scintillators, which are positioned on the x-ray table and simultaneously exposed to an x-ray beam. Before the x-ray beam is supplied to the detectors, it is passed through a first filter sufficient to remove or attenuate the lower energies of the beam energy distribution. Removing the lower energies of the x-ray beam results in the beam having an energy distribution which increases in penetrating power as a function of the kVp applied to the x-ray generator. The first detector is responsive to the filtered beam for generating an output signal representing the magnitude of the radiation energy of the filtered beam. In accordance with the present invention, the filtered x-ray beam is further attenuated by a second filter before it is supplied to the second detector which generates an output signal representing the magnitude of radiation energy of the twice filtered beam.

The present invention includes means responsive to the first and second detector output signals for generating an indication of the voltage supplied to the x-ray generator. Both detectors generate an output voltage proportional to the amount of radiation received. The ratio between the detector output signals is proportional to the amount of voltage supplied to the x-ray generator. The output of the first detector is supplied to a first integrator to generate a first ramp voltage signal, and the output of the second detector is supplied to a second integrator to generate a second ramp voltage output signal. The output of the first integrator is monitored by a trigger circuit which includes a comparator for generating a set signal to a latch when the magnitude of the first ramp output signal reaches a predetermined reference level.

The output of the second integrator is supplied to an input of a sample/hold circuit. The setting of the latch triggers a monostable multivibrator to generate a signal to the sample/hold circuit which causes the circuit to read and store the value of the second ramp signal at the time when the first ramp signal reaches the predetermined reference level. The ratio between the stored value and the predetermined reference level corresponds to the ratio between the outputs of the first and second detectors, and is, therefore, a function of the kVp generated by the x-ray tube. The stored voltage is then biased by a range control to generate a voltage proportional to the actual kVp by a multiple of ten. This voltage can then be supplied to a conventional voltmeter which will indicate the voltage directly in kVp units.

BRIEF DESCRIPTION OF THE DRAWINGS

Other advantages of the invention will be apparent to those skilled in the art from the following detailed description of the invention, when considered in the light of the accompanying drawings in which.

DESCRIPTION OF THE PREFERRED EMBODIMENT

Figure 1:
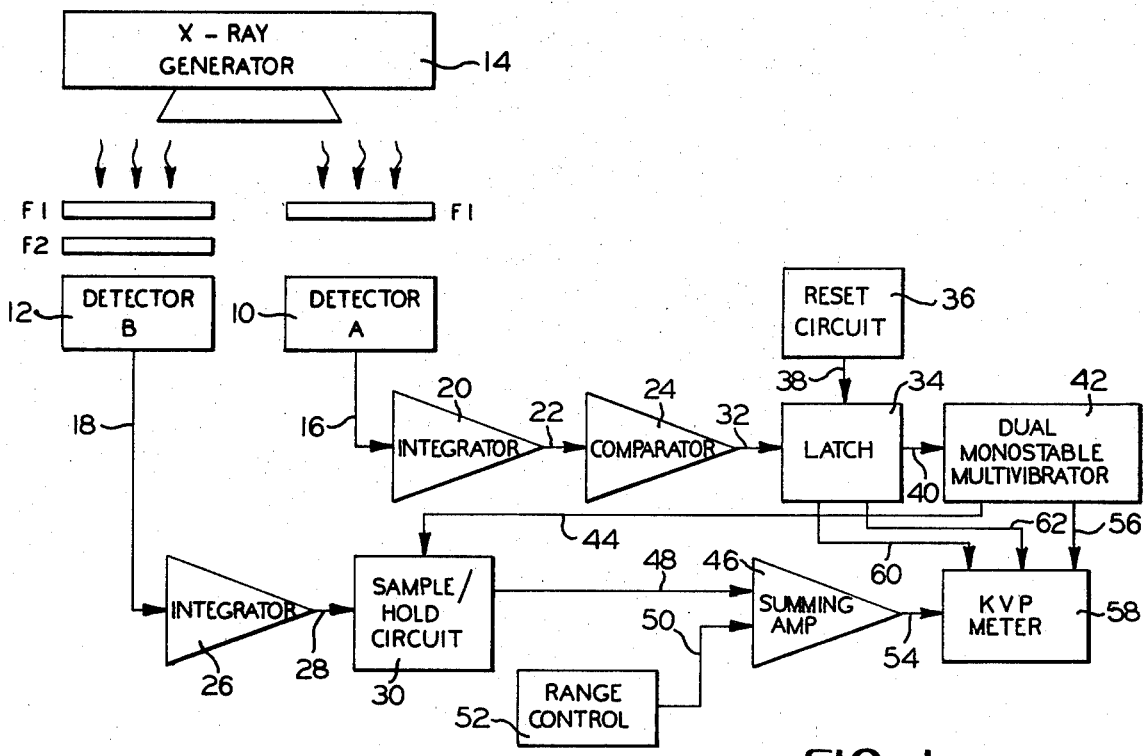
FIG. 1 is a block diagram of a radiation monitoring device according to the present invention.

There is shown in FIG. 1 a block diagram of the monitoring device according to the present invention. The device includes a pair of radiation detectors, Detector A 10 and Detector B 12, which are positioned on an x-ray table (not shown) to receive a beam of radiation from an x-ray generator 14. The x-ray beam generated by the generator 14 is filtered by a first filter F1 before being supplied to the detector 10, and the beam is filtered by a similar filter F1 and an additional filter F2 before being supplied to the detector 12. The detectors 10 and 12 generate output signals on lines 16 and 18 respectively having a magnitude proportional to the amount of radiation received through the respective filters.

The signal on the line 16 is supplied to a first integrator 20 which generates a ramp voltage output signal on a line 22 to a comparator 24. The output of the detector 12 on the line 18 is an input signal to a second integrator 26 which generates a ramp output signal on a line 28 to a sample/hold circuit 30. When the incoming ramp signal on the line 22 reaches a predetermined reference magnitude, the comparator 24 generates an output signal on the line 32 to set a latch 34. A reset circuit 36 is provided to generate a reset signal on the line 38 to permit an operator to manually reset the monitoring device after it has been subjected to an exposure. When the latch 34 receives a set signal on the line 32 from the comparator 24, the latch 34 will generate a signal on a line 40 to trigger a dual monostable multivibrator 42.

The multivibrator 42 will generate a first output signal on a line 44 to the sample/hold circuit 30 when triggered. When the sample/hold circuit receives this output signal, it will read the value of the ramp signal on the line 28 and store this value. The stored value is then supplied to a summing amplifier 46 on a line 48 where it is combined with a bias signal on a line 50 generated by a range control 52. As will be discussed, the range control 52 permits an operator to select the desired bias and gain of the summing amp 46 such that the output voltage of the summing amplifier on the line 54 will be proportional to the kVp of the beam by a multiple of ten. This permits the monitoring device of the present invention to use a conventional voltmeter which will indicate the voltage supplied to the x-ray generator directly in kVp units.

The multivibrator 42 generates a second output signal on a line 56 to the kVp meter 58 to signal the meter 58 to read the output of the summing amp on the line 54. The meter 58 also receives control signals on lines 60 and 62 from the latch 54 which are utilized to enable the meter and the associated display when it is desired to display a kVp value. Typically, the meter 58 is a conventional voltmeter of either the analog or digital type.

As previously mentioned, each of the radiation detectors 10 and 12 will generate a voltage directly proportional to the amount of radiation received through the respective filters. The filters F1 can be a sheet of aluminum or copper having a thickness sufficient to remove or attenuate the lower energies of the x-ray beam energy distribution. Once the lower energies have been attenuated, the penetrating power of the beam becomes a function of the kVp applied to the x-ray tube generator. The filter F2 can be an additional metal sheet which further attenuates the beam before it is supplied to the second detector 12. Since the penetrating power of the first filtered beam is a function of the kVp applied to the x-ray tube, a particular value of kVp energy should result in a particular value of attenuation through the second filter F2.

Figure 2:
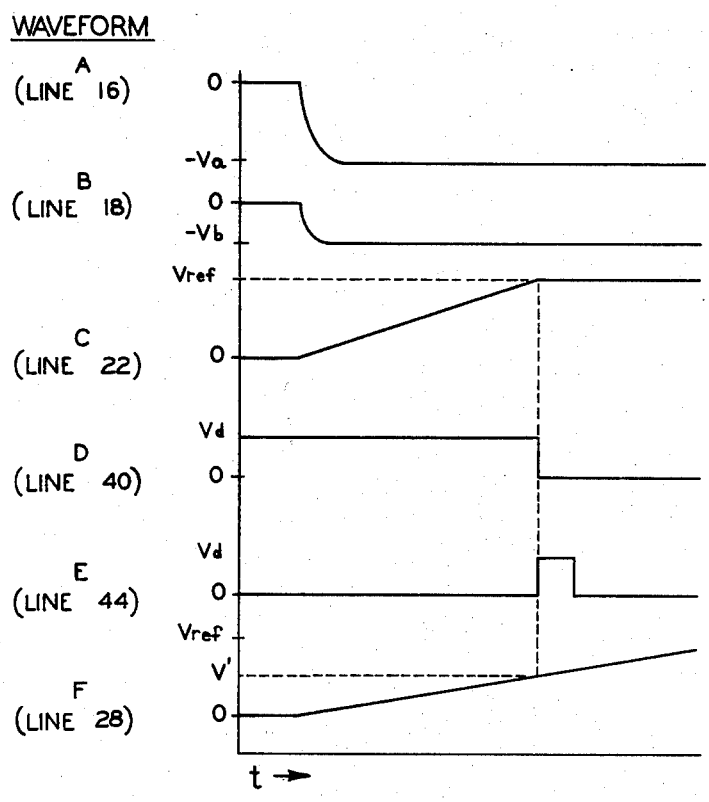
FIG. 2 is a waveform diagram illustrating a group of wave-forms generated by the circuit of FIG. 1.

The present invention determines the actual attenuation introduced by the filter F2 by calculating the ratio between the two detector output signals. This ratio is then used to produce a reading of the actual kVp supplied to the x-ray tube. For example, if the x-ray machine is set to produce an eighty kVp beam exposure, and the machine is correctly calibrated, the present invention would obtain a ratio which corresponds directly to the amount of attenuation an eighty kVp beam should encounter when passed through the filter F2. The present invention would then display a reading corresponding to eighty kVp to inform the operator that the machine is correctly calibrated. If the machine is not correctly calibrated, the monitoring device of the present invention would obtain a ratio which differs from the expected amount of attenuation. The present invention would then display a reading corresponding to the actual kVp of the beam. There is shown in FIG. 2 a group of waveforms which will be utilized to explain the manner in which the circuit of FIG. 1 calculates the ratio between the two detector output signals. When an exposure is initiated, the detector 10 will generate a signal on the line 16 similar to the waveform A shown in FIG. 2. Similarly, the second detector 12 will generate a signal on the line 18 similar to the waveform B shown in FIG. 2. Since the x-ray beam supplied to the second detector 12 is attenuated more than the beam supplied to the first detector 10, the voltage generated on the line 18, shown as a $-Vb$ voltage in FIG. 2, will be lower than the voltage generated on the line 16 by the first detector 10, shown in FIG. 2 as voltage $-Va$.

It should be noted that the outputs of the detectors 10 and 12 typically do not result in output signals which are as uniformity level as they are shown in FIG. 2. Consequently, it is desirous to integrate the two output signals before attempting to calculate a ratio between the two signal. In FIG. 2, the ramp output of the first integrator 20 is shown as waveform C, and the ramp output of the second integrator 26 is shown as waveform F. When the output of the first integrator 20 reaches a predetermined reference level, shown as voltage Vref in FIG. 2, the comparator 24 will set the latch 34. When the latch is set, the latch output on the line 40 changes from $+Vd$ potential to a ground potential, as shown in waveform D of FIG. 2. The logic "1" to logic "0" transition of the latch output triggers the multivibrator 42 to generate an enable pulse, shown in waveform E, to the sample/hold circuit 30. The sample/hold circuit 30 will then read and store the current voltage level V' of the ramp signal on the line 28, shown as waveform F in FIG. 2.

The ratio between the magnitudes of the stored signal V' and the reference level Vref corresponds to the ratio between the outputs of the second and first detectors respectively. As previously mentioned, this ratio is proportional to the additional attenuation of the beam supplied to the second detector. In the preferred embodiment of the present invention, the reference level Vref is selected to be 10.0 volts. In this case, the stored V' signal in the sample/hold circuit represents the ratio between the magnitudes of the V' and Vref signals times a factor of 10.

Figure 3:
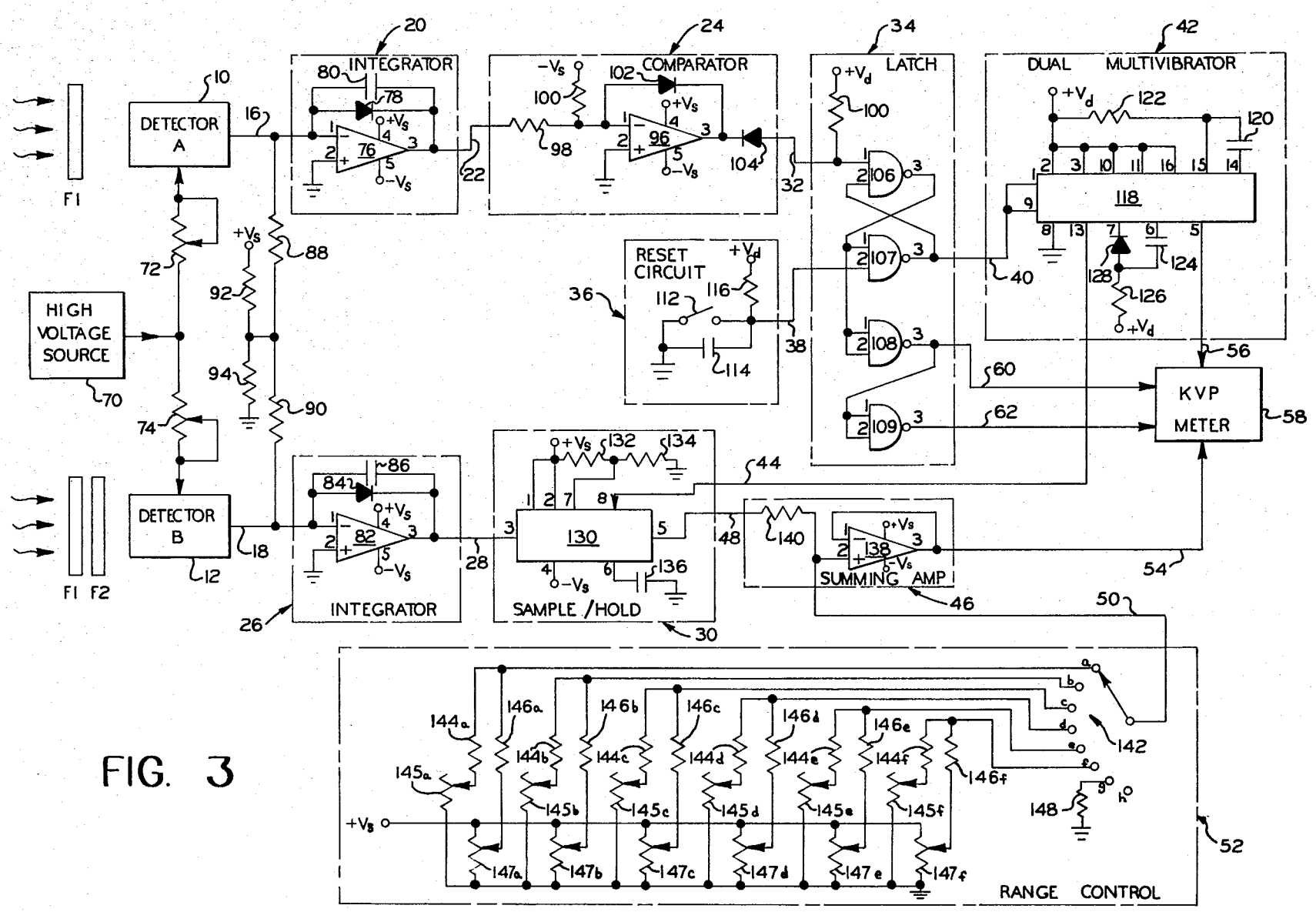
FIG. 3 is a more detailed schematic drawing of the radiation monitoring device of FIG. 1.

There is shown in FIG. 3 a more detailed schematic diagram of the invention shown in FIG. 1. In FIG. 3, the detector 10 and the detector 12 are connected to a high voltage source 70 through potentiometers 72 and 74 respectively. Typically, the detectors 10 and 12 can each be a photomultiplier which is positioned to receive light from a scintillator exposed to the x-ray beam. The scintillator can consist of a small square of calcium tungstate x-ray intensifying screen, while the photomultiplier tube can be Hamamatsu type R241 four-stage photomultiplier tube. Although many types of photomultiplier tubes can be used, it is important that the dark current of the photomultiplier is sufficiently low to prevent the output of the integrators 20 and 26 from creeping upward prior to the actual exposure. This upward creep caused by the leakage current of ordinary detectors or poor photomultiplier tubes could give rise to false or incorrect readings. Another type of photomultiplier tube which can be used is a ten-stage photomultiplier tube with five stages bypassed in order to obtain sufficient gain with very low output dark current. As will be discussed, the potentiometers 72 and 74 are utilized to adjust the voltage applied to the detectors 10 and 12 so that the gain of the respective photomultiplier tubes will be matched. In addition to photomultiplier tubes, the other types of detectors can also be used such as, for example, silicon cells, solar cells, modified solar cells coated with an x-ray sensitive phosphor, or ion chambers.

The integrator 20 includes an operational amplifier 76 having an inverting input 76-1 connected to receive the output of the detector 10 on the line 16 and a non-inverting input 76-2 connected to the ground potential. A capacitor 86 is connected between the input 76-1 and an output 76-3. A diode 78 has an anode connected to the input 76-1 and the cathode connected to the output 76-3. The output 76-3 is connected to generate the output ramp signal on the line 22. The amplifier 76 has a positive power supply terminal 76-4 connected to a +Vs power supply (not shown) and a negative power supply terminal 76-5 connected to a −Vs power supply (not shown).

The integrator 26 is similar to the integrator 20 and includes an operational amplifier 82 having an inverting input 82-1 connected to receive the output of the detector 12 on the line 18 and a non-inverting input 82-2 connected to the ground potential. A capacitor 86 is connected between the input 82-1 and an output terminal 82-3. A diode 84 has an anode connected to the input 82-1 and the cathode connected to the output 82-3. The output 82-3 is connected to generate the output ramp signal on the line 28 to the sample/hold circuit 30. The amplifier 82 has a positive power supply terminal 82-4 connected to the +Vs power supply and a negative power supply terminal 82-5 connected to the −Vs power supply. Both the amplifiers 76 and 82 can be a general purpose operational amplifier such as a model AU741C manufactured by Texas Instruments.

Typically, the high voltage source 70 provides a relatively large negative potential to both the detectors 10 and 12. Upon detecting a radiation exposure, the detectors will generate a negative potential signal on the respective output lines having magnitudes directly to the amount of radiation detected. The integrators 20 and 26 function to integrate the negative magnitude signals on the lines 16 and 18 to produce positive output ramp signals on the lines 22 and 28, illustrated in FIG. 2 as waveforms C and F respectively. The diodes 78 and 84 are provided in the integrators 20 and 26 to prevent any positive signals appearing on the lines 16 and 18 from being integrated.

A pair of biasing resistors 88 and 90 are connected in series between the output lines 16 and 18. A voltage divider consisting of resistors 92 and 94 is connected between the +Vs power supply and the ground potential. The junction between the resistors 92 and 94 is connected to the junction between the resistors 88 and 90. Typically, the resistance value of the resistor 92 is large as compared to the resistance value of the resistor 94 such that the junction between the resistors 88 and 90 is maintained at a positive potential slightly above ground potential. This biases the inputs 76-1 and 82-1 of the amplifiers 76 and 82 at a positive potential to help prevent any upward creep of the ramp output signals before the actual exposure is initiated.

The comparator 24 includes an operational amplifier 96 having an inverting input 96-1 connected to receive the output ramp signal on the line 22 through a resistor 98. Another resistor 100 is connected between the −Vs power supply and the input 96-1. The amplifier 96 has a non-inverting input 96-2 connected to the ground potential. A diode 102 has an anode connected to the input 96-1 and a cathode connected to an output terminal 96-3. The output 96-3 is connected to the cathode of a diode 104 having an anode connected to generate the set signal on the line 32. The amplifier 96 has a positive power supply terminal 96-4 connected to the +Vs power supply, and a negative power supply terminal 96-5 connected to the −Vs power supply. The amplifier 96 can be of the type similar to amplifiers 76 and 82.

The resistors 100 and 98 function to maintain the amplifier input 96-1 at a negative potential when the magnitude of the ramp signal on the line 22 is below a predetermined reference value.

When the magnitude of the input 96-1 is less than ground potential, the amplifier 96 generates a positive output signal at the terminal 96-3 to reverse bias the diode 104. As the magnitude of the ramp signal on the line 22 increases, the voltage at the input 96-1 will become less negative. When the voltage at the input 96-1 reaches ground potential, the output of the amplifier 96-3 will switch to ground potential to forward bias the diode 104 and pull the line 32 to ground. The magnitude of the signal on the line 22, which determines when the comparator generates the set signal on the line 32, is dependent on the value of the resistances 98 and 100 and the value of the −Vs power supply. For example, if the −Vs power supply is a −15 volt power supply, and it is desirious to have the comparator 24 generate the set signal when the magnitude of the ramp signal on the line 22 reaches 10 volts, the resistances 100 and 98 are chosen at a ratio of 3 to 2.

The latch 34 includes four NAND gates 106 through 109. The NAND gates 106 and 107 are connected in a flip flop configuration. The NAND 106 has an input 106-1 connected to receive the set signal on the line 32 and the NAND 107 has an input 107-2 connected to receive the reset signal on the line 38. An output 106-3 is connected to the input 107-1 and the output 107-3 is connected to the input 106-2. The output of the NAND 107 is connected to generate a trigger signal to the multivibrator 42 on the line 40. A resistor 110 is connected between a +Vd power supply (not shown) and the input 106-1 to maintain the input 106-1 at a logic "1" level when no set signal is present on the line 32. The output of the NAND 106-3 is also connected to inputs 108-1 and 108-2 of the NAND 108 having an output 108-3 connected to supply a status signal to the meter 58 on the line 60. The output 108-3 is connected to inputs 109-1 and 109-2 of the NAND 109 having an output 109-3 connected to supply a second status signal to the meter 58 on the line 62. Both the NANDs 108 and 109 function as inverters to supply status signals to the meter 58 which can be used to turn on the meter when it is desired to display a kVp value, and turn off the meter when there is no value to be displayed.

The reset circuit 36 includes a reset switch 112 having one terminal connected to the ground potential and the other terminal connected to an input 107-2 of the NAND 107. A capacitor 114 is connected across the terminals of the switch 112. A resistor 116 is connected between the +Vd power supply (not shown) and the input 107-2 to maintain the input 107-2 at a logic "1" when the reset switch 112 is not activated. Depressing the reset switch 112 resets the latch 34 and causes the meter 58 to turn off.

The dual monostable multivibrator 42 includes a multivibrator integrated circuit 118 which can be a model SN54123 manufactured by Texas Instruments. It should be noted that the terminal numbers shown in FIG. 3 correspond directly to the terminal numbers of the model SN54123. The trigger signal on the line 40 is connected to both inputs 118-1 and 118-9 of the two internal multivibrators. The output pulse width of the first internal multivibrator is controlled by a capacitor 120 connected between external capacitor inputs 118-14 and 118-15 and a resistor 122 connected between the input 118-15 and the +Vd power supply. The output of the first internal multivibrator is generated at the output terminal 118-13 which is connected to the line 44 supplied to the sample/hold circuit 30. The output pulse width of the second internal multivibrator is controlled by a capacitor 124 connected in series with a resistor 126 between external capacitor output 118-6 and the +Vd power supply. A diode 128 has an anode connected to the junction between the capacitor 124 and the resistor 126 and a cathode connected to an external resistor/capacitor terminal 118-7. A positive power supply input 118-16 is connected to the +Vd power supply and a ground input 118-8 is connected to the ground potential. The output of the second internal multivibrator is generated at the output terminal 118-5 which is connected to supply the signal to the meter 58. This signal can be utilized to inform the meter 58 to read the output of the summing amplifier 46 on the line 54. A pair of auxiliary inputs 118-2 and 118-10 and a pair of clear inputs 118-3 and 118-11 are connected to the +Vd power supply to disable the respective functions.

The sample/hold circuit 30 includes a precision sample/hold integrated circuit chip 130 such as model LF198 manufactured by National Semiconductors. It should be noted that the terminal numbers shown in FIG. 3 correspond directly to the pin numbers on chip model LF198. The sample/hold 130 has an analog input 130-3 connected to receive the output of the integrator 26 on the line 28. The enable signal on the line 44 from the multivibrator 42 is connected to a logic input 130-8. The inputs 130-1 and 130-2 are both connected to the +Vs power supply. A resistor 132 is connected between the +Vs power supply and the input 130-7. Another resistor 134 is connected between the input 130-7 and the ground potential. A negative power supply input is connected to the −Vs power supply. A storage capacitor 136 is connected between a capacitor input 130-6 and the ground potential.

The summing amplifier 46 includes an operational amplifier 138 having a non-inverting input 138-2 connected to receive the output of the sample/hold circuit 30 on the line 48 through a resistor 140. The inverting input 138-1 is connected directly to the output 138-3 which is connected to the line 54. The amplifier 138 can be of a type similar to the amplifiers 76 and 82.

The summing amplifier is also connected to receive a biasing signal on the line 52 from the range control 50. The range control 50 includes a range switch 54 having one terminal connected to the line 52 and a plurality of second terminals a through f connected to a set of biasing and gain control resistors. A plurality of gain control resistors include resistors **144*a* through 144*f* which are connected between the terminals a through f of the rotary switch 142 and the adjustable terminals of gain control potentiometers 145*a* through 145*f* respectively. One of the fixed terminals of each of the potentiometers 154*a* through 145*f* are connected to the ground potential. A plurality of biasing control resistors include resistors 146*a* through 146*f* connected between the terminals a through f of the rotary switch 142 and the adjustable terminal of potentiometers 147*a* through 147*f* respectively. The fixed terminals of the potentiometers 146*a* through 146*f* are connected in parallel between the +Vs power supply and the ground potential. A resistor 148 is connected between a switch terminal 142*g* and the ground potential to provide a small amount of gain when the switch is moved to the terminal g, which defines the open loop position. A switch terminal 142*h*** is left unconnected.

The gain control potentiometers **145*a* through 145*f* are adjusted in conjunction with the bias control potentiometers 147*a* through 147*f*** such that the output of the summing amplifier will be at a magnitude corresponding to the actual kVp of the exposure and will change in direct proportion to a change in the kVp energy of the beam. Each set of gain control and bias control potentiometers can be individually adjusted such that each position of the range control defines a particular kVp value at which the machine is to be calibrated. For example, if the machine is to be calibrated at eighty kVp, the filter F2 can be selected such that the output of the second integrator will be at approximately one-half of the predetermined reference level when it is sampled. Thus, if the reference level is ten volts, for example, the output of the second integrator will be approximately five volts when the output of the first integrator reaches ten volts. The bias and gain controls can be adjusted such that, if the machine is correctly calibrated at eighty kVp, the meter will read 0.08 volts, and the meter reading will vary by 0.01 volts for each one kVp change of x-ray energy.

In order to compensate for any gain drift of photomultiplier tube detectors, an operator first performs a trial exposure wherein the filter F2 is removed such that both photomultiplier tubes are exposed to the same filtered beam. In this case, the range switch is set to the position h and the meter 58 will display a value related to the output of the second integrator 26. The value of the resistance 148 is selected such that, when the gain of both tubes has been set correctly, the meter will be at a predetermined value. The potentiometers 72 and 74 can be used to adjust and correct the gain of the detectors.

In addition to matching the gains of the two detectors 10 and 12, the potentiometers 72 and 74 can also be adjusted to control the sensitivity of the detectors to ensure that the output of the first integrator 20 does not reach the predetermined reference level too quickly. For example, the potentiometer 72 can be adjusted such that, an exposure of eighty kVp at ten mAs (milliampere-seconds) will not be sufficient to cause the output of the integrator 20 to reach the predetermined reference level, whereas an eighty kVp exposure of fifteen or more mAs will be sufficient. It should be noted that in some instances, it may be desirious to incorporate the gain and sensitivity adjustments into the integrators 20 and 26.

In summary, the present invention concerns an apparatus for indicating the voltage applied to a means for generating a beam of x-rays and passing a first portion of the beam through a filter means. The apparatus includes two detector means. The first detector means is responsive to the filtered first portion of the beam for generating a signal representing the magnitude of the radiation energy of the first portion of the beam. The second detector means is responsive to a second portion of the beam for generating a signal representing the magnitude of the radiation energy of the remainder of the beam. Means are responsive to the first and second detector signals for generating an indication of the voltage applied to the means for generating a beam of x-rays. Typically, the indication of the voltage is generated by determining the ratio between the first and second detector signals.

In accordance with the provisions of the patent statutes, the principle and mode of operation of the invention have been explained in its preferred embodiment. However, it must be understood that the invention may be practiced otherwise than as specifically illustrated and described without departing from its spirit or scope.

What is claimed is:

1. An apparatus for indicating the voltage applied to a means for generating a beam of x-rays, a first portion of the beam passing through a filter means, comprising:

first detector means responsive to the filtered first portion of the beam for generating an output signal representing the magnitude of the radiation energy of the first portion of the beam;

second detector means responsive to the remainder of the beam for generating an output signal representing the magnitude of the radiation energy of the remainder of the beam;

means responsive to the output signals of said first and second detector means for generating an indication of the voltage applied to the means for generating the beam of x-rays, said means including a first integrator means responsive to the output signal of said first detector for generating a first ramp output signal, a second integrator means responsive to the output signal of said second detector for generating a second ramp output signal, and means responsive to the first and second ramp output signals for generating the indication of voltage;

trigger means responsive to the first ramp output signal for generating an enable signal when the magnitude of the first ramp output signal reaches a predetermined reference level; and means responsive to the second ramp signal and the enable signal for storing a signal representing the magnitude of the second ramp output signal.

2. An apparatus according to claim 1 wherein said indication generating means includes means for generating a signal representing the ratio between said magnitudes represented by said first and second detector signals.

3. An apparatus according to claim 1 wherein said trigger means includes a comparator means responsive to said first ramp signal for generating a set signal when the magnitude of said first ramp signal reaches said predetermined reference level, latch means responsive to said set signal for generating a latch signal, and a multivibrator means responsive to said latch signal for generating said enable signal.

4. An apparatus according to claim 1 wherein said first and second detectors are photomultiplier tubes.

5. An apparatus according to claim 4 including means for individually adjusting the gain of said tubes.

6. An apparatus according to claim 1 including a display means for displaying said signal representing the stored magnitude of said second ramp signal to indicate the voltage.

7. An apparatus according to claim 6 including means for biasing said stored magnitude signal whereby said display means displays the voltage in kVp units.

8. An apparatus according to claim 6 wherein said display means is an analog voltmeter.

9. An apparatus according to claim 6 wherein said display means is a digital voltmeter.

10. An apparatus for indicating the voltage applied to a means for generating a beam of x-rays, the beam passing througgh a first filter means and a portion of the filtered beam passing through a second filter means, comprising:

first detector means responsive to the first filtered beam for generating an output signal representing the magnitude of the radiation energy of the first filtered beam;

second detector means responsive to the second filtered portion of the beam for generating an output signal representing the magnitude of the radiation energy of the second filtered portion of the beam;

means responsive to the output signals of said first and second detector means for generating an indication of the voltage applied to the means for generating the beam of x-rays, said means including a first integrator means responsive to the output signal of said first detector for generating a first ramp output signal, a second integrator means responsive to the output signal of said second detector for generating a second ramp output signal, and means responsive to the first and second ramp output signals for generating the indication of voltage;

trigger means responsive to the first ramp output signal for generating an enable signal when the magnitude of the first ramp output signal reaches a predetermined reference level; and means responsive to the second ramp signal and the enable signal for storing a signal representing the magnitude of the second ramp output signal.

11. An apparatus for indicating the voltage applied to a means for generating a beam of x-rays comprising:

means for filtering a portion of the beam of x-rays to produce a first filtered beam;

means for filtering a portion of said first filtered beam to produce a second filtered beam;

first detector means responsive to the first filtered beam for generating a signal representing the magnitude of the radiation energy of the first filtered beam;

second detector means responsive to the second filtered beam for generating a signal representing the magnitude of the radiation energy of the second filtered beam;

means responsive to the signals of said first and second detector means for generating an indication of the voltage applied to the means for generating the beam of x-rays, said responsive means including a first integrator means responsive to the signal of said first detector means for generating a first ramp output signal, a second integrator means responsive to the signal of said second detector means for generating a second ramp output signal, and means responsive to the first and second ramp output signals for generating the indication of voltage;

trigger means responsive to the first ramp output signal for generating an enable signal when the magnitude of the first ramp output signal reaches a predetermined reference level; and means responsive to the second ramp signal and the enable signal for storing a signal representing the magnitude of the second ramp output signal.

12. A method for indicating the voltage applied to a means for generating a beam of x-rays, a first portion of the beam passing through a filter means, comprising the steps of:

(a) generating a first detector signal representing the magnitude of the radiation energy of the filtered first portion of the beam;

(b) generating a second detector signal representing the magnitude of the radiation energy of the remainder of the beam;

(c) generating a first ramp output signal in response to the signal of the first detector;

(d) generating a second ramp output signal in response to the signal of the second detector;

(e) generating an indication of the voltage in response to the first and second ramp output signals;

(f) generating an enable signal when the magnitude of the first ramp output signal reaches a predetermined reference level; and (g) storing a signal representing the magnitude of the second ramp output signal in response to the second ramp output signal and the enable signal.

* * * * *